US005635667A

United States Patent [19]

Boyer et al.

[11] Patent Number: 5,635,667

[45] Date of Patent: Jun. 3, 1997

[54] FUSE PLUG PYROTECHNIC FIRING DEVICE

[75] Inventors: Jean L. Boyer, Collobrieres, France; André J. N. Gilson, Brussels, Belgium

[73] Assignees: Etat Francais, Represente par le Delegegue General pour L'Armament, Paris, France; Jason Engineering S.A., Brussels, Belgium

[21] Appl. No.: 490,813

[22] Filed: Jun. 15, 1995

[30] Foreign Application Priority Data

Jun. 16, 1994 [FR] France ..... 94 07381

[51] Int. Cl.[6] ..... F42B 27/00; F42C 9/14

[52] U.S. Cl. ..... 102/487; 102/265; 102/268; 102/270; 102/271

[58] Field of Search ..... 102/482, 487, 102/488, 265, 266, 268, 269, 270, 271

[56] References Cited

U.S. PATENT DOCUMENTS

| | | | |
|---|---|---|---|
| 2,763,212 | 9/1956 | McCaslin | 102/488 |
| 2,836,118 | 5/1958 | Hjelm | 102/268 |
| 3,115,094 | 12/1963 | Simmen | 102/270 |
| 3,148,621 | 9/1964 | Varaud | 102/270 |
| 3,557,701 | 1/1971 | Arnell | 102/488 |
| 3,823,669 | 7/1974 | Zacharin . | |
| 4,078,496 | 3/1978 | Kruger et al. | 102/487 |
| 4,730,559 | 3/1988 | Brightman | 102/487 |
| 5,335,803 | 8/1994 | Robinet et al. | 102/487 |

FOREIGN PATENT DOCUMENTS

| | | |
|---|---|---|
| 2353041 | 12/1977 | France . |
| 2458790 | 1/1981 | France . |
| 2465189 | 3/1981 | France . |
| 2500619 | 8/1982 | France . |
| 2517048A1 | 5/1983 | France . |
| 2682471A1 | 4/1993 | France . |
| 1428801 | 4/1969 | Germany . |
| 426556 | 6/1967 | Switzerland . |
| 8701193 | 2/1987 | WIPO . |

*Primary Examiner*—Michael J. Carone
*Assistant Examiner*—Theresa M. Wesson
*Attorney, Agent, or Firm*—Oliff & Berridge

[57] ABSTRACT

A fuse plug pyrotechnic firing device includes a body, a pyrotechnic train, a firing pin and a driving device. The body has an axis and a bore disposed along the axis. The pyrotechnic train is disposed along the axis and includes an upper part and a lower part. The firing pin has a firing pin axis and is disposed within the bore between the upper part and the lower part. The firing pin is also disposed to ignite the lower part. The driving device is coupled to the firing pin and to the upper part. The driving device drives the firing pin to move along the firing pin axis and to ignite the lower part, the firing pin rotating about the firing pin axis under pressure of gases generated by the ignition of the lower part. As a result, safe and effective operation of the fuse plug pyrotechnic firing device is ensured.

27 Claims, 12 Drawing Sheets

FUSE PLUG PYROTECHNIC FIRING DEVICE

BACKGROUND OF THE INVENTION

The present invention relates to the technical area of pyrotechnic charge firing devices of the fuse plug type, notably for hand grenades, that include a pyrotechnic circuit detonated conventionally by a firing pin operated by the movement of a handle associated with a cotter pin.

This firing device must meet the requirements of safety, reliability and low production cost. In particular, for safety during storage and transit, the pyrotechnic train must be configured so that it can be disabled.

This device must also allow the user to select one of the following three firing modes for the pyrotechnic charge: delay, impact mode, or an impact-delay mode.

It must be possible for all the component parts to be manufactured using an automated production process. Their assembly should permit the use of robotic production equipment. In this technical field a number of designs have been proposed.

French Patent FR 2.517.048 discloses a fuse plug for a hand grenade having three modes of operation with storage and operational safeties that interrupt the pyrotechnic train and lock the firing pins. This plug has two pyrotechnic trains having one part in common, one train being related to one firing pin specifically for delayed operation and the other train working with a second firing pin specifically for impact operation. The grenade operating mode is selected using an outer ring fitted with a stud against which a plate turns under rotary motion from a timer. This plate also determines the alignment of the pyrotechnic train which results after the cotter pin is removed and a delay is determined by the timer.

This fuse plug has several disadvantages. In particular, it incorporates two principal non-aligned firing pins that collaborate with two pyrotechnic trains, leading to complex manufacture and operation.

Another disadvantage lies in the fact that the alignment of the pyrotechnic train and the arming of the operating modes both depend on a timer, which can have an adverse effect on safety and on the functional reliability of such a fuse plug. A fire, kinetic energy impact or nearby explosion can lead to the accidental ejection of the cotter pin followed by rotation of the plate, leading to an irreversible alignment of the pyrotechnic train.

In addition, the impact-delay function is equivalent to self-destruction of the grenade in the absence of percussion, and not to a delay function triggered by the impact function.

French Patent FR 2.458.790 discloses a multi-purpose fuse plug with a throwing safety. This plug, which is very similar to that described in the previous patent, can operate in four different ways, and includes two independent, principal firing pins each corresponding to different modes of operation, and a selector having two rotating discs controlled by a timer movement in storage and operation of the throwing safety. This fuse plug also includes an impact detector coupled to one of the firing pins which is configured in an armed position directly after release of the handle, which necessitates the throwing safety.

Most of the disadvantages mentioned above are also found here. Notably, the use of a timer mechanism, which may become faulty, to control the alignment of the pyrotechnic train, as well as to ensure ignition safety, is disadvantageous.

With regard to the impact-delay mode, the delay function is not triggered by the impact function.

French Patent FR 2.682.471 also discloses a storage safety for a fuse plug that interrupts the pyrotechnic train. This interruption is obtained by a pivoting element with a radial orifice positioned between a delay module and a primer composition. Rotation of this part, caused indirectly by the release of the handle, automatically aligns the pyrotechnic train.

French Patent FR 2.465.189 also shows a fuse plug for a grenade that includes a pyrotechnic train interrupted by a rotating device operated by a delay mechanism involving the release of glass beads, which allows definitive alignment of the train after a predetermined time interval following initiation of the train.

The operating principle of the pyrotechnic train interruptions described in these two patents and in the patents mentioned earlier have the major drawback of resulting in an automatic and irreversible alignment of the train during storage in a hostile environment.

Moreover, if any single component essential to locking should fail, which could, for example, occur by accident with no persons present (due to fire, explosion or impact), the firing procedure is inevitably initiated.

SUMMARY OF THE INVENTION

The aim of the present invention is to counter the disadvantages mentioned above by proposing a device for firing a pyrotechnic charge of the ignition plug type applicable notably, but not exclusively, to hand grenades, giving enhanced safety during storage, transport and utilization, high operational reliability, low manufacturing and assembly costs and being perfectly suitable for industrial mass-production.

Another purpose of the invention is to ensure safety during storage and transport in fully primed sections by interrupting the pyrotechnic train.

Another objective of the invention is to provide a fuse plug that is directly adaptable to different types of pyrotechnic device and more particularly to several types of hand grenade (offensive, defensive, tear gas, smoke or practice), while retaining conventional means of initiation such as the combination of handle and cotter pin.

Another aim is to allow the user to select, on the fuse plug, one of the three following operating modes of the pyrotechnic charge:delay mode, impact mode or impact-delay mode.

To this end, the subject of the invention is a device for firing a pyrotechnic charge, of the fuse plug type notably for a hand grenade, comprising, accommodated in an axial bore made in the body of the plug, a pyrotechnic train in two parts upper and lower, the lower part being initiated by an axial firing pin positioned between the two parts of the train and associated with means of operation collaborating with a means of locking. This device has mechanical means for operating the firing pin, which are introduced between the upper part of the train and the pin in order to displace the firing pin axially and in rotation about its axis under the pressure of gas generated by the initiation of the upper part.

The mechanical means of operating the firing pin preferably collaborate with a guide device in a channel in the bore of the plug body.

The means of operating the hollow cylindrical firing pin preferably consist of a spring and a piston sliding axially with respect to the central bore, housed in a fixed internal cylindrical casing containing the upper part of the pyrotechnic train, this casing being partially fitted into the firing pin.

The means of locking the firing pin to the internal casing may consist of a ball projecting into a recess in the casing and allowing the firing pin to move from an initial safe position, in which the piston traps the ball in a circular groove inside the firing pin, to an armed position, following axial displacement of the piston, in which the ball positioned opposite a circular groove on the outside of the piston escapes from the circular groove inside the firing pin and releases said pin.

The guide system preferably consists of a ball projecting into the central bore engaged in the channel made on the outer wall of the firing pin, this channel comprising a longitudinal part extended by a spiral part, so as to accomplish an initial axial displacement of the firing pin followed by a second displacement of the same firing pin which is both rotational and axial.

The device may comprise a firing pin locking module positioned between the pin and the lower part of the pyrotechnic train.

This locking module of .cylindrical shape may have three series of openings of different lengths arranged around the circumference of the module, to accommodate at least one stud on the firing pin.

The firing pin may comprise three external studs arranged at 120° intervals around its circumference and positioned opposite one of the three sets of openings also arranged on the module in order to accomplish either the locking of the firing pin in a safety position for storage and transport, or a functional locking of the pin in the armed position, or the ignition of the lower part of the train.

The device preferably comprises a self-destruct module comprising a gas generating composition contained inside the piston and initiated by the upper part of the train, an exhaust vent made in the piston which, after displacement of the piston, is positioned opposite an axial volute attached to the firing pin, in order to cause the pin to rotate and be axially displaced under the effect of the means of operation, followed by ignition of the lower part of the train.

The gas generating composition contained inside the piston may consist of a delay composition associated with a reinforcing composition.

According to a preferred embodiment, the ignition device according to the invention, comprising an axial system for interrupting the pyrotechnic train placed in the lower part of the train housed in a cylindrical casing, comprises mechanical means to drive the axial interruption element operated simply by rotating the head of the fuse plug, thus allowing the train to be aligned and misaligned by hand.

This interruption element may consist of a cylinder with an axial bore, mounted on an alignment drum rotated by mechanical means from the cylinder being in a radial position to an axial position and conversely.

The mechanical means of rotating the drum may consist of an internal rotatable cylindrical part partially housed in the casing and connected at its lower end to the drum, its upper end being driven by the rotation of the body and head of the plug.

According to a first embodiment, the drum is fitted with a pin engaged in a spiral groove made in the cylindrical casing, which rotates the cylinder through 90°.

According to a second embodiment, the drum comprises teeth engaged in a rack in the casing to rotate the cylinder through 90°.

The lower part of the pyrotechnic train preferably comprises in turn a percussion cap, a lead azide charge, a further hexagon primer, the cylindrical interruption device and then a principal hexagon relay charge.

According to a preferred embodiment, the interruption cylinder also contains an intermediate relay charge of secondary explosive of the hexagon type.

The pyrotechnic charge firing device according to the invention applied to a three-function fuse plug allowing delayed, impact or impact-delay operation of the charge, of the type comprising an operating mode selector, an impact detector module and a delay module, is preferably fitted with a selector consisting of the outer cylindrical wall of the plug head, which can be rotated about the cylindrical body of the plug pierced by the central bore.

The delay module integrated with the selector can comprise a mechanical rocker controlling the rotation of at least one gear wheel engaged in at least one axial rack attached to the outer wall of the firing pin, to produce a percussion delay in the impact-delay mode.

According to a variant embodiment, the outer wall of the firing pin carries four parallel racks of different lengths each corresponding to percussion delays of one second, seven tenths, four tenths and one tenth of a second.

For preference, an omnidirectional impact detector module with adjustable sensitivity will be used, for the impact and impact-delay modes, housed in an axial bore of the cylindrical body of the plug, comprising a master cylinder associated with a first spring, a second cylinder associated with a second spring, a transverse detection ball inserted between the master cylinder and the second cylinder, two locking and unlocking balls for the module operated by the axial displacement of the firing pin and another functional locking and unlocking ball for the module preventing or permitting its operation through the action of the selector.

The transverse detection ball in the impact detector module is preferably made of a dense material such as tungsten. The selector preferably comprises in the safe position means that prevent the extraction of a cotter pin locking a handle and an upper firing pin controlling the initiation of the upper part of the train.

In a preferred mode of operation, the rotary selector occupies an initial safe position and adopts, in successive 90° rotations, at least three different positions, each corresponding to one of the modes of operation:

in the safe position, the cotter pin is locked, the pyrotechnic train is interrupted by the element held in the radial position, the firing pin, whose three studs are opposite the three short safety openings, is locked by the ball being trapped in the circular groove inside the firing pin, the gear wheel of the delay module is separated from the firing pin racks, and the impact detector module is locked by the two balls that respectively lock the master cylinder and the second cylinder under the action of the firing pin in the initial position, moreover the functional locking ball held by the selector also locks the master cylinder;

an initial rotation of the selector through 90°, corresponding to the delayed operation of the charge, results in turn in the unlocking of the cotter pin to allow it to be extracted, alignment of the pyrotechnic train by rotating the interruption device through 90° and the rotation of the locking module relative to the firing pin by positioning the three longest openings in the module opposite the three firing pin studs corresponding to the firing pin functional locking position, the delay and impact detector modules remaining inactive;

a second rotation of the selector through 90°, corresponding to impact operation, also causing the release of the functional locking ball of the impact detector module, this then entering a circular groove inside the selector in order to activate this module;

a third rotation of the selector through 90°, corresponding to impact-delay operation, leading in addition to alignment of the gear wheels of the delay module with the first rack of the firing pin corresponding to a percussion delay of one second, the impact detector module remaining active.

According to an operational variant, with the selector in the impact-delay position, three additional rotations of the selector in the same direction bring about the alignment of the gear wheel of the delay module with, in turn, the second rack of the firing pin corresponding to a percussion delay of seven tenths, the third rack of the firing pin corresponding to a percussion delay of four tenths and the fourth rack of the firing pin corresponding to a percussion delay of one tenth of a second.

According to another operational variant, with the selector in the impact and impact-delay positions and in the absence of the operation of the impact detector module, the self-destruct module together with the firing pin operating means ignite the lower part of the train followed by the explosion of the device.

One advantage of the fuse plug according to the invention lies in the compactness of its structure and the modular design of its component parts, significantly simplifying the firing conditions and the manufacturing stages encountered during largely automated production.

This fuse plug with several operating modes offers optimal safety in firing and storage. In particular, the element that interrupts the pyrotechnic train judiciously arranged within the lower part of the said train is independent of the environment thus giving improved efficiency in case of accidental initiation of the upper part of the train, during transport or storage of the plug associated with the pyrotechnic charge.

This interruption element can be displaced only by the deliberate action of the operator. Consequently the purely manual alignment and misalignment of the pyrotechnic train cannot result from a conjunction of external hostile elements.

This has the advantage that the fuse plug mounted on a fully primed hand grenade for example can be stored in complete safety, which is not the case at present with existing fuse plugs. Another advantage stems from the fact that the principal initiation relay is positioned at the center of the main initiating charge, thus ensuring isotropic detonation of the pyrotechnic charge.

Other characteristics and advantages of the invention will be evident from the detailed, non-limiting description of one embodiment of the invention.

BRIEF DESCRIPTION OF THE DRAWINGS

This description will make reference to the attached drawings wherein.

DETAILED DESCRIPTION OF PREFERRED EMBODIMENTS

Figure 1:
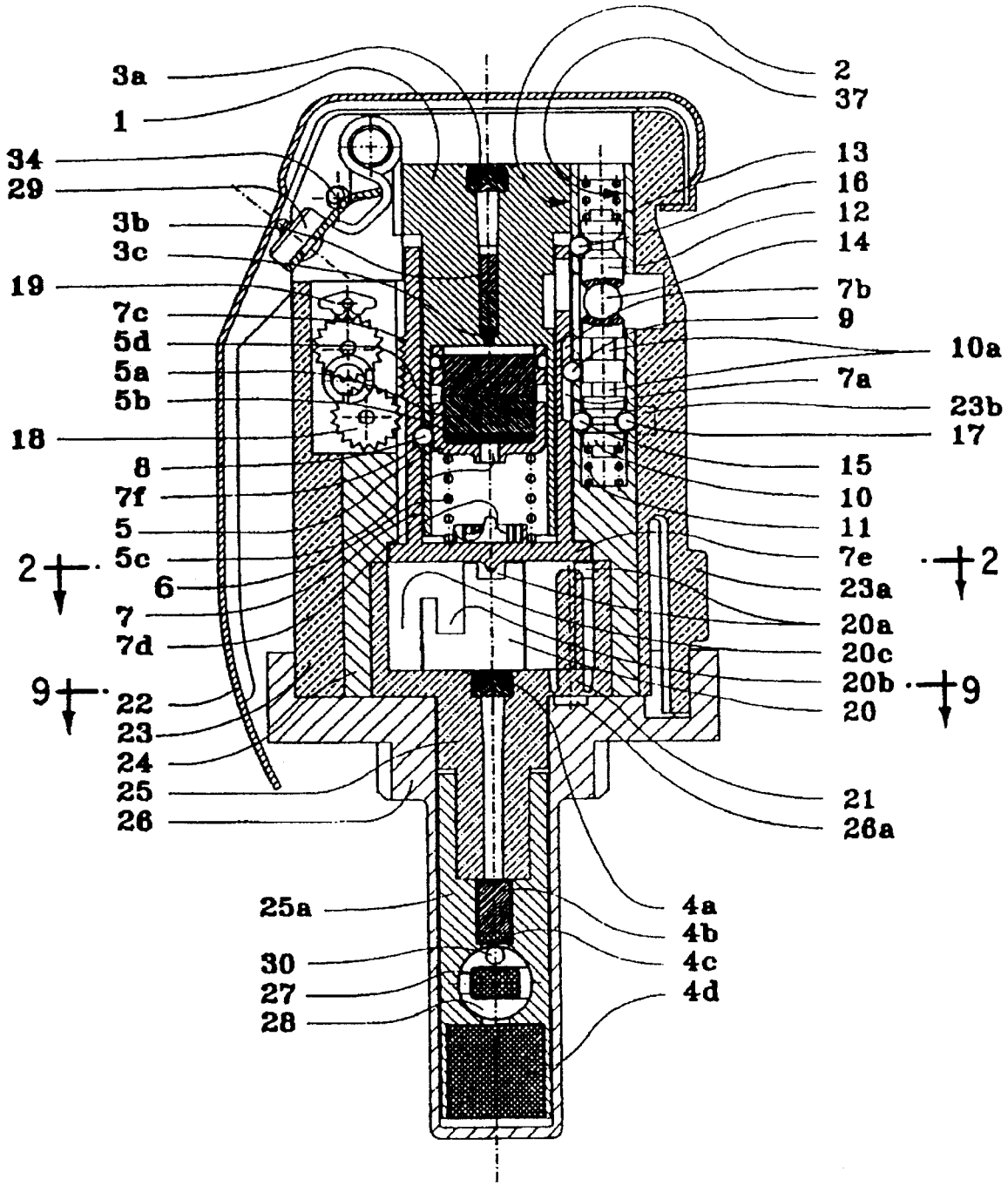
FIG. 1 is an axial section of a three-function fuse plug according to the invention, in the safe position.
Figure 2A:
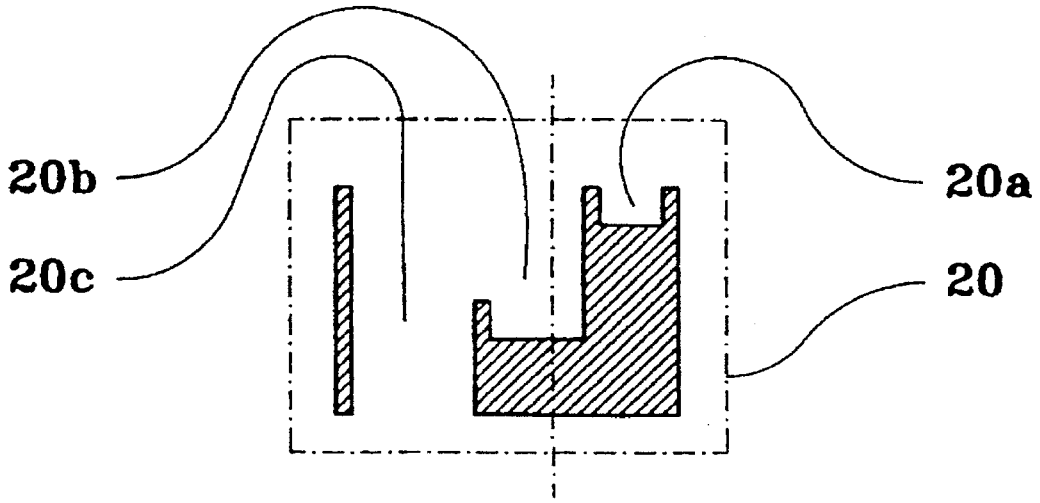
FIG. 2A is a view showing only the locking module of FIG. 1.
Figure 2:
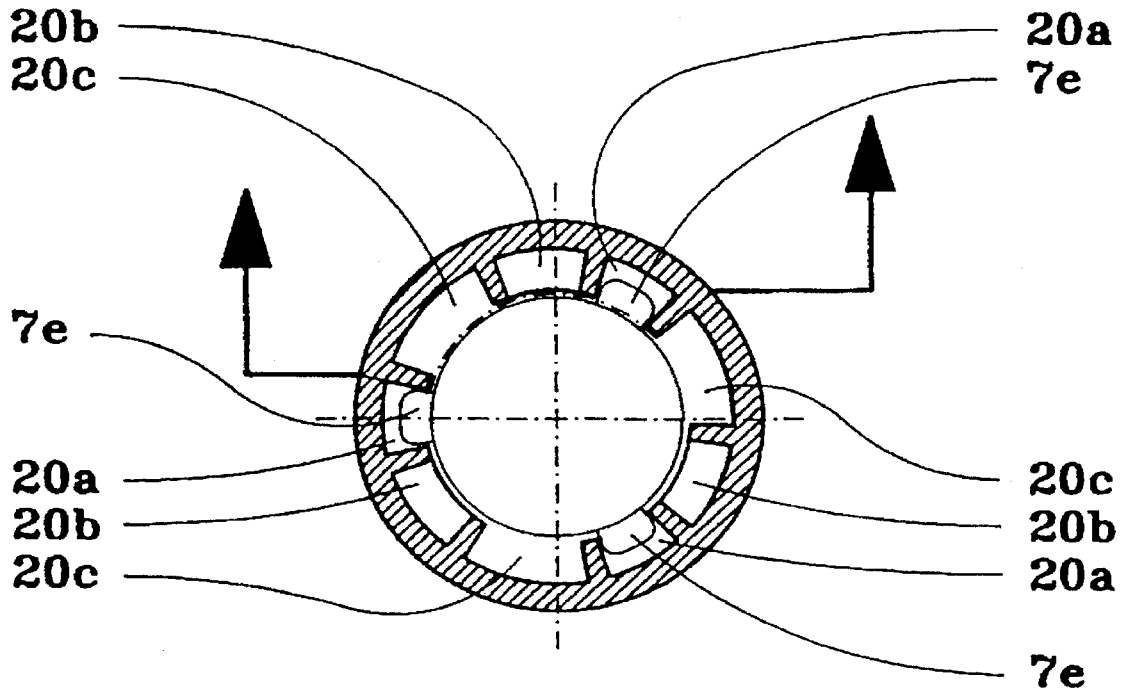
FIG. 2 is an enlarged view along 2—2 of FIG. 1 of the locking module associated with the firing pin in the storage or transport position.
Figure 3:
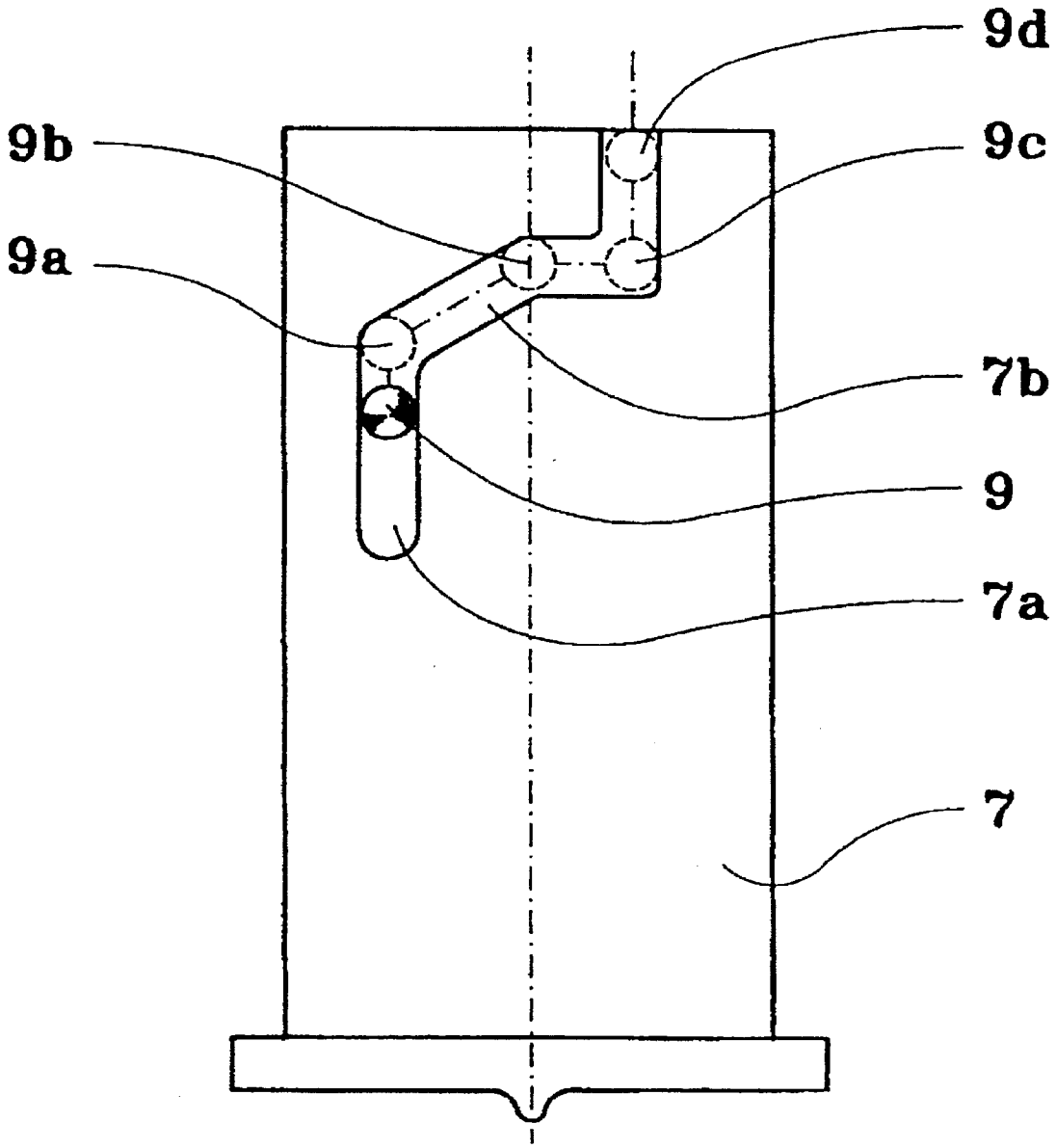
FIG. 3 is a side view of the firing pin showing on a larger scale the path followed by the guide device in the longitudinal and spiral channel involved in the displacement of the firing pin.

FIGS. 1 to 3 show a three-function fuse plug substantially cylindrical in shape that includes, in its lower part, a casing 26 threaded on the outside for fitting the plug, for example, to a hand grenade (not shown). The main part of the plug is attached to the lower part and is free to rotate. The head of the plug is attached to the top of the main part and includes a conventional device for initiating a pyrotechnic train, such as a cotter pin 34 and a handle 22 operating an upper firing pin 29.

The main part of the plug includes three superimposed, coaxial, hollow, cylindrical parts 23, 24 and 25 which can rotate with respect to one another. The cylindrical parts have two axial bores 2 and 37. The axial bore 2 extends into the fixed casing 26 so that the main part can be screwed into the grenade.

The following are fitted into this central bore 2 made in the cylindrical part 24, from top to bottom:

an internal casing 1, attached to the cylindrical part 24, with a solid upper part in which a central cylindrical housing is made containing an upper part 3 of a pyrotechnic train in two parts, and a hollow lower part;

a primer cap 3*a*, a pyrotechnic delay 3*b* and a gas generating booster charge 3*c*, constituting the upper part 3 of the train;

a hollow cylindrical piston 5 sliding axially which has an external circular groove 5*d* and an axial gas exhaust vent 5*c* at its bottom, the piston being held in the upper position by a spring 6, the piston and the spring being housed in the hollow bottom of the casing 1;

a gas generating composition that includes a delay composition 5*a* with a booster composition 5*b* contained in the piston 5;

a hollow cylindrical firing pin 7 having a U-shaped axial section and being disposed to move axially in translation and in rotation about its axis with respect to the fixed internal casing 1 partially contained in the firing pin;

a ball 8 for locking and unlocking the firing pin to/from the casing 1 projecting into a recess at the bottom of this casing such that when the piston is in the upper position, the ball contacts the outer wall of the piston and is engaged in an internal circular groove 7*f* of the firing pin; and a firing pin locking module 20 (FIG. 2) arranged under the firing pin and formed as a single piece with the cylindrical part 25 having a hollow cylinder with three series of axial openings 20*a*, 20*b* and 20*c* arranged at 120° intervals around its circumference, a first series having three short openings 20*a* for storage and transport safety, a second series having three longer openings 20*b* for functional safety and a third series having three through openings 20*c* allowing the firing pin to pass freely.

The lower end of the bore 2 communicates with a coaxial hole in the fixed casing 26 containing the lower part 4 of the pyrotechnic train.

The bottom of the firing pin 7 has three external studs 7*e* arranged at 120° intervals around its circumference capable of penetrating the three series of openings 20*a*, 20*b* and 20*c* in the locking module. On the inner surface of the lower part of the firing pin 7, an axial volute 7*d* is attached in communication with the exhaust vent 5*c* of the piston 5 in the lower position to cause the firing pin to rotate under the effect of the gases produced by the combustion of the pyrotechnic composition 5*a* and 5*b* contained in the piston 5.

The locking module also includes an axial locking indication stud 21 projecting to the outside of the module through an opening 26*a* in the module when one of the three studs 7*e* of the firing pin is bearing against its top. In the extended position, the stud acts as a stop to prevent relative rotation of the module 20 and the selector 23 with respect to the fixed casing 26 and to indicate to the operator that the firing pin is in the safe position.

A channel 7*a*, 7*b* (FIG. 3) is made in the outer cylindrical wall of the firing pin 7. The channel 7*a*, 7*b* includes a longitudinal part 7*a* extended by a spiral part 7*b* in which is engaged a guide device consisting of a ball 9 that rotates in an open recess made in the casing 24 of the plug and projects into the central bore 2 of the plug.

In FIG. 3, the different positions of the ball 9 in the longitudinal channel 7*a* and the spiral channel 7*b* during the movement of the firing pin are shown as dotted lines. The ball successively occupies the positions 9*a*, 9*b*, 9*c* and 9*d* after, respectively, an initial axial displacement of the firing pin, a second rotary and axial displacement corresponding to the armed position of the firing pin, a third displacement caused by the action of the self-destruct module, and a fourth displacement leading to the self-destruct percussion or to that of the delayed operating mode.

The configuration of the guide device and of the channel described above is not limiting. A different embodiment in which the channel is made in the body 24 of the plug at the bore and the guide device is placed on the cylindrical wall of the firing pin 7, for example, is also covered by the present invention.

Figure 4:
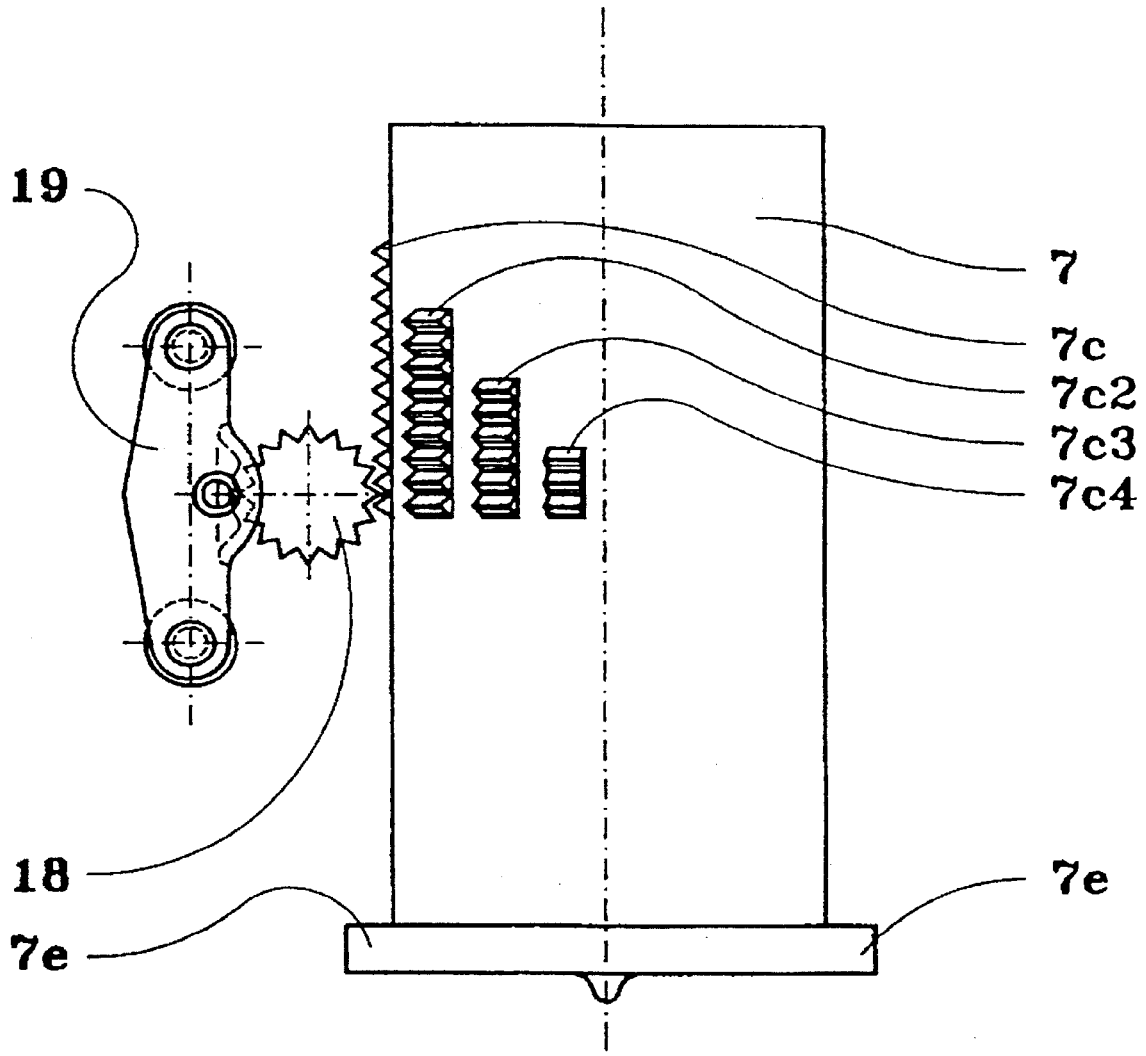
FIG. 4 is a side view of the firing pin associated with the delay module.

Four parallel axial racks 7*c*, 7*c*2, 7*c*3 and 7*c*4 (FIG. 4) with different lengths are attached to an area of the outer cylindrical wall of the firing pin diametrically opposite to the position of the channel described above. In the impact-delay mode of operation of the charge, as will be described below, these racks provide percussion delays of one second, seven tenths, four tenths and one tenth of a second (FIG. 4), respectively.

A delay module is placed through an opening made in the body 24 of the plug in the outer cylindrical part 23 forming the head of the plug for selecting the different operating modes of the pyrotechnic device. The delay module, which is integrated with the selector 23 by any known means, is rotated by the said selector around the firing pin into alignment with one of the four axial racks on the firing pin in the impact-delay mode.

This entirely mechanical delay module comprises a rocker 19 controlling the position of one or more gear wheels 18 capable of engaging one of the four racks according to the length of percussion delay chosen by the operator using the selector 23.

An omnidirectional impact detector module with adjustable sensitivity is fitted in the second axial bore 37, the diameter of which may or may not be equal to that of the central bore 2.

This second bore 37 is made in the body 24 of the plug at a short distance from the central bore 2.

This impact detector module, used in impact mode and in impact-delay mode, includes:

a master cylinder 10 associated with a first spring 11 that contacts the bottom of the bore 37 and the bottom of the master cylinder;

a secondary cylinder 12 associated with a second spring 13 that contacts the top end of the bore 37 and on the top of the secondary cylinder;

a transverse tungsten detection ball 14, interposed between the master cylinder and the secondary cylinder and disposed to move radially in a housing inside the body 24 of the plug and the selector 23;

two balls 15 and 16, moving radially in two recesses in the part of the body 24 situated between the two bores 2 and 37 and each projecting into these two bores, respectively locking the master cylinder 10 and the secondary cylinder 12 in the upper position of the firing pin 7 and unlocking the master cylinder and secondary cylinder after the axial displacement of the firing pin; and a ball 17 which can move radially in a recess in the body 24, providing functional locking of the module under the action of a selector 23 which keeps it engaged in a groove in the master cylinder 10, and functional unlocking allowing the module to operate after rotation of the selector about the body 24 allowing this ball to escape from the groove in the master cylinder and enter an internal circular groove 23*b* in the selector.

When the firing pin 7 is in the upper position, the locking functions of these two parts of the module are provided by the firing pin which keeps each of the balls 15 and 16 engaged in the corresponding groove in the master cylinder and secondary cylinder. The master cylinder 10 is in contact with the ball 9 and keeps it engaged in the channel 7*a*, 7*b* of the firing pin.

The master cylinder has two necked zones 10*a* which, following axial displacement of the master cylinder cause, by a longitudinal or transverse impact, allow the ball 9 to escape from the channel, releasing the firing pin.

Figure 8A:
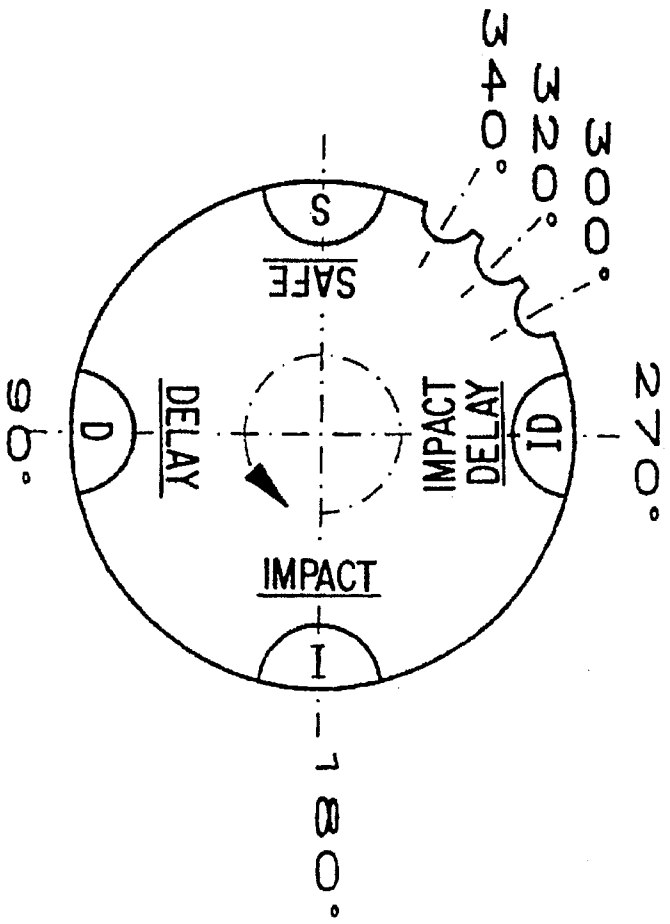
FIGS. 8 and 8A represent a top view of the selector with an indication of the different modes of operation, showing the means of locking the cotter pin in the safe position.

The lower part of the selector 23 formed by the cylindrical top of the plug includes a flexible ratchet 23*a* which snaps into a circular notch made in the fixed casing 26. Around the circumference of the top of the selector 23 (FIG. 8A) are four principal markers corresponding to the positions of safety, delayed operation, impact operation and impact-delay operation. The operator selects one of the four markers by successive 90° rotations. In the impact-delay position, the selector shows three secondary markers, accessible by successive rotations of 20A for example, corresponding to the different percussion delays described above.

Figure 8:
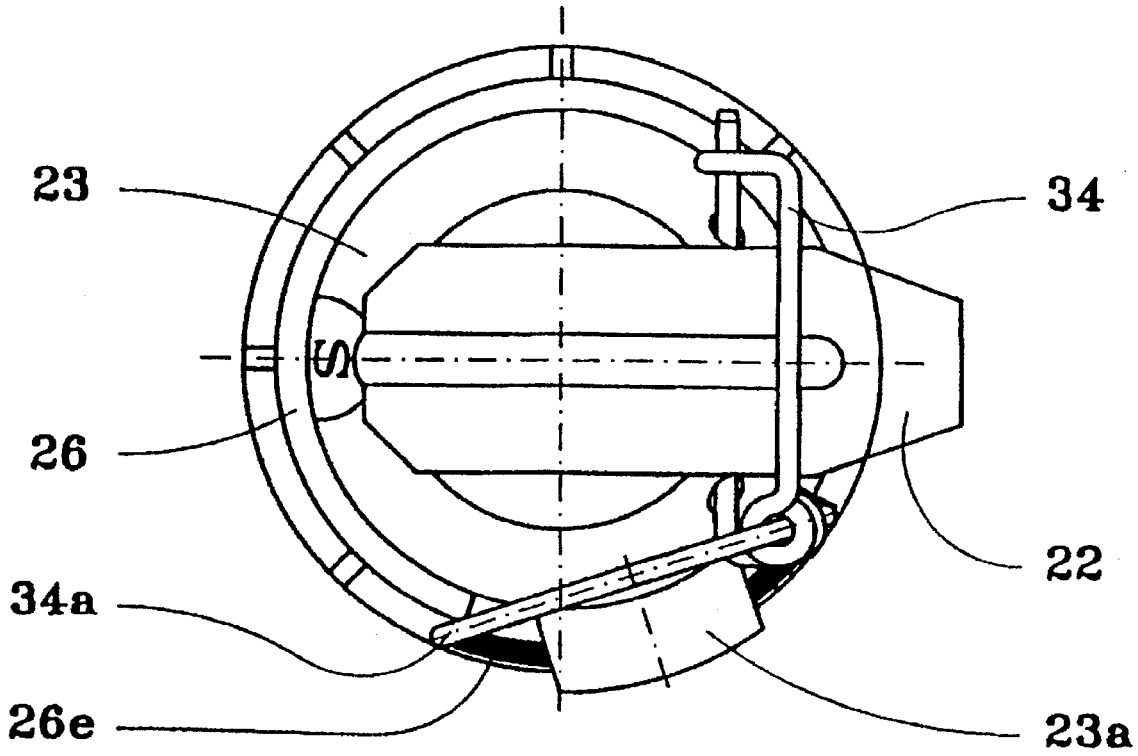

An outer part of the circumference of the top of the casing 26 includes a circular rib 26*e* (FIGS. 5 and 8) which traps, with the flexible ratchet 23*a* of the selector in the safe position, part of a ring 34*a* connected to the cotter pin 34 to prevent the cotter pin from being extracted only when the selector is in the safe position.

Figure 5:
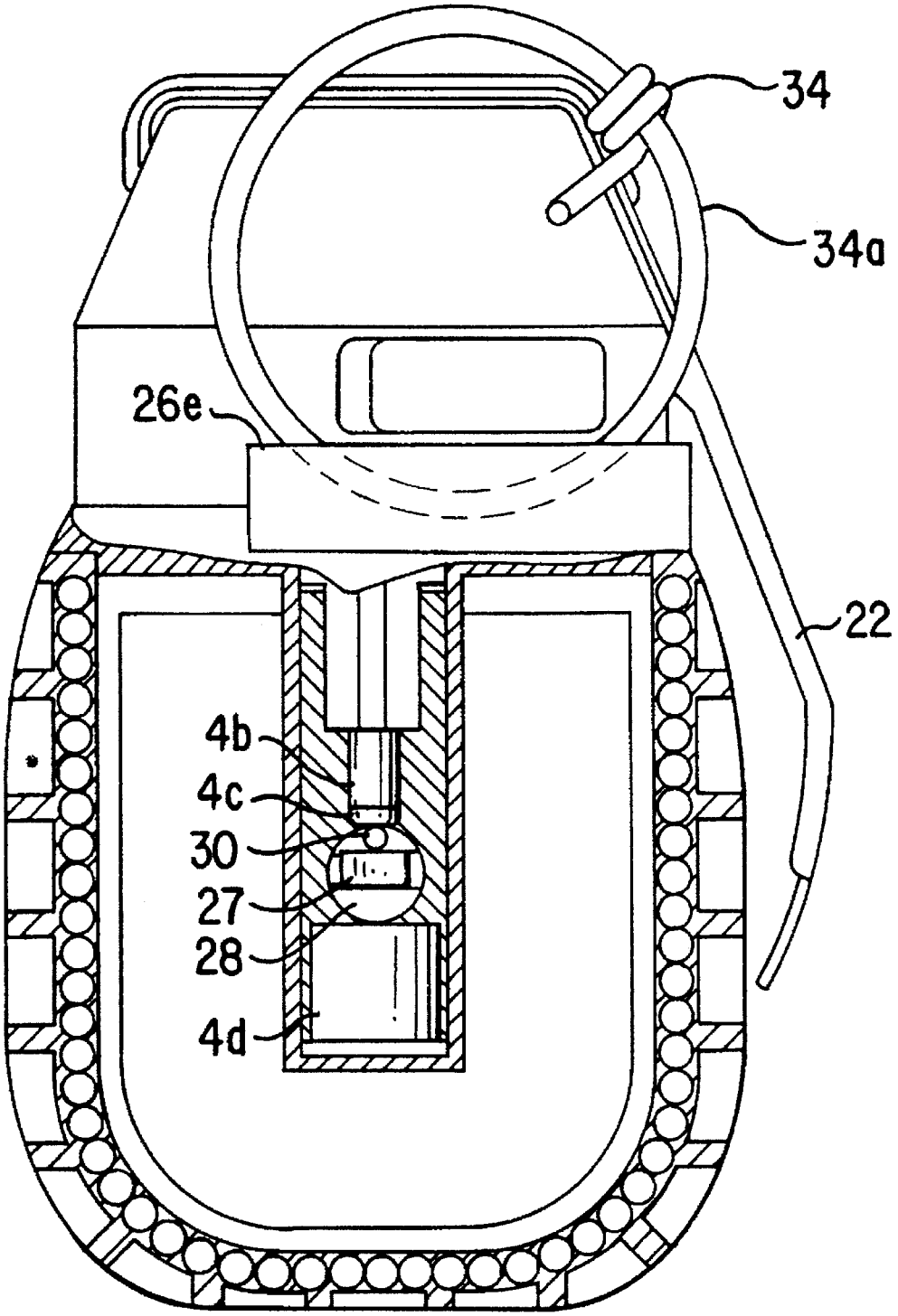
FIG. 5 is an axial section of an offensive-defensive hand grenade fitted with a fuse plug according to the invention, showing more particularly the lower part of the pyrotechnic train with its interruption device, in the safe position, together with the means of locking the cotter pin.
Figure 6:
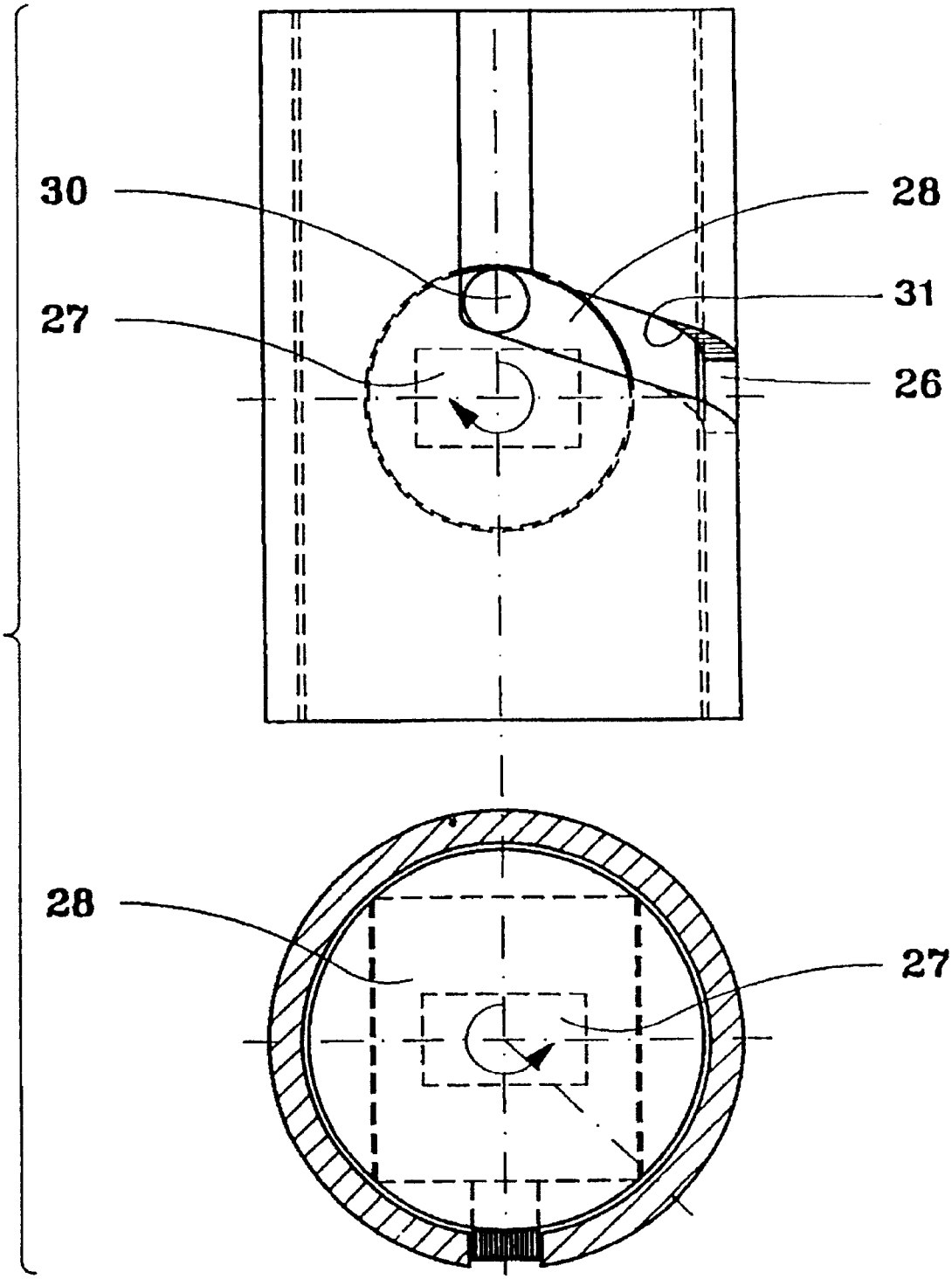
FIG. 6 is a larger scale view of the pyrotechnic train interruption device of FIG. 5, according to a first embodiment.
Figure 7:
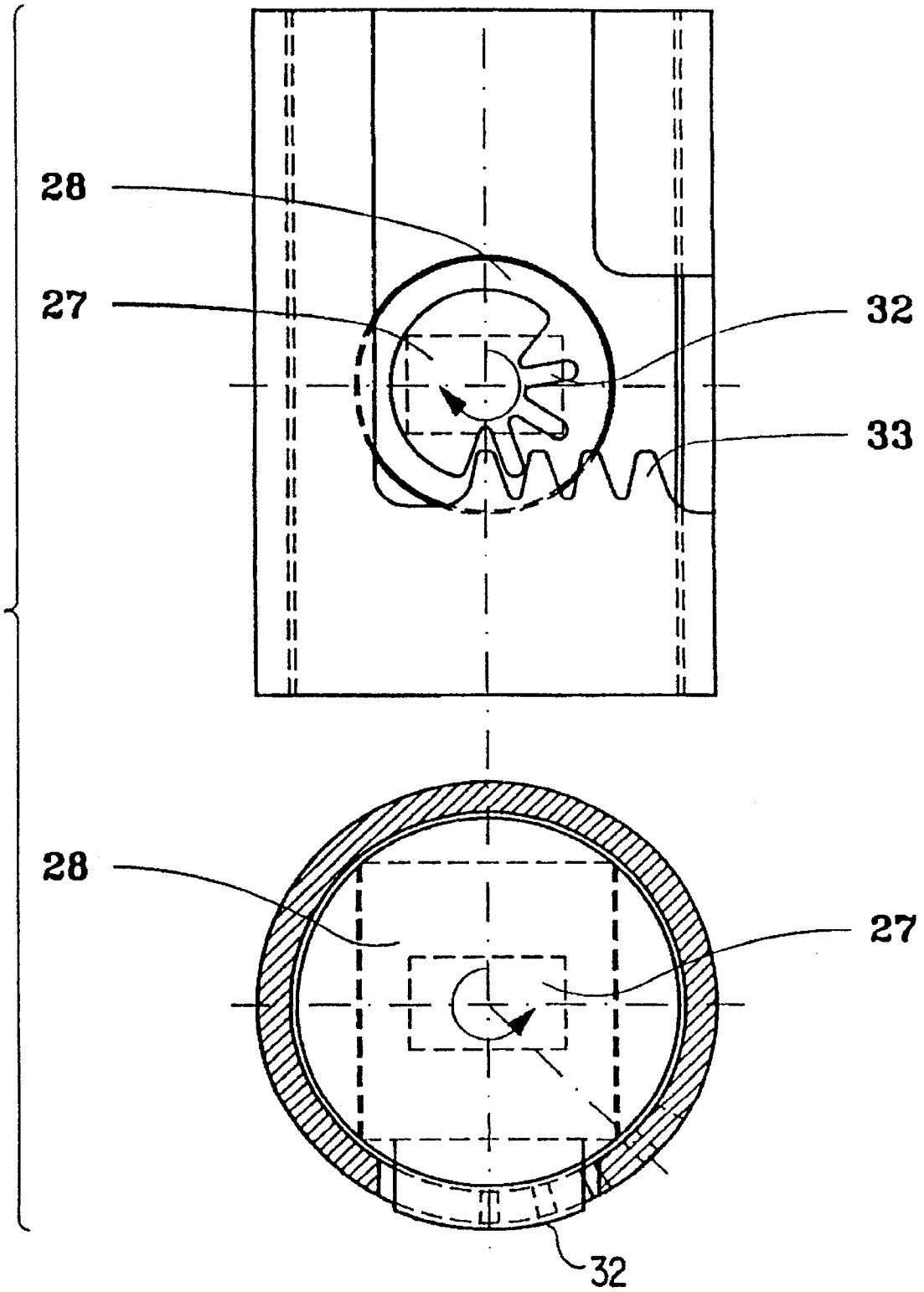
FIG. 7 is a view identical to FIG. 6 of a second embodiment of this device.

The fixed cylindrical casing 26 screwed into the grenade contains the lower part 4 of the pyrotechnic train. From top to bottom, the lower part 4 includes: a percussion cap 4*a*, a lead azide charge 4*b*, a hexagon primer 4*c*, a train interruption cylinder 27 and a principal hexagon relay charge 4*d* (FIGS. 5 to 7).

The train interruption cylinder 27 for interrupting or misaligning the pyrotechnic train consists of a cylinder with an axial orifice and preferably containing an intermediate relay charge of a secondary explosive of the hexagon type. The train interruption cylinder is attached in any known manner to a cylindrical drum 28 that rotates between a radial position to an axial position of the device.

The cylindrical drum is caused to rotate by a mechanical device that is actuated by the manual rotation of the selector 23 and formed by the head of the plug. The mechanical device includes an internal cylindrical part 25 the bottom part of which 25*a* is housed in the casing 26 and the upper part of which contains the locking module, that is rotated by the body 24 of the plug enclosed by the selector 23.

According to a first embodiment (FIG. 6), the mechanical device includes a spiral groove 31 made in the casing 26 associated with a pin 30 on the drum 28 and disposed to rotate in the lower end 25*a* of the internal part 25, so as to produce a rotation of 90° of the interruption device 27 by a conjoint rotation of 45° of the body 24 and of the selector in the initial safe position. Beyond 45°, the upper part of the part 25 is locked to the fixed casing 26 to keep the pyrotechnic train aligned for the three modes of operation.

Returning the selector 23 to the safe position unlocks the part 25 from the casing 26 and skews the pyrotechnic train into misalignment returning the device 27 to the radial position.

According to a second embodiment (FIG. 7), the system of spiral groove 31 and pin 30 is replaced by a gear wheel 32 of the drum 28 engaging a circular rack 33 of the casing 26 to align and misalign the pyrotechnic train by rotating the interruption device 27 through 90°.

The ignition device according to the invention is operated as follows.

With the fuse plug mounted in the safe position on an explosive device such as a hand grenade, for example, the operator selects one of the three modes of operation by manually rotating the head 23 of the plug around the fixed casing 26 screwed on the device.

Figures 10A, 10B, 10C, 10D:
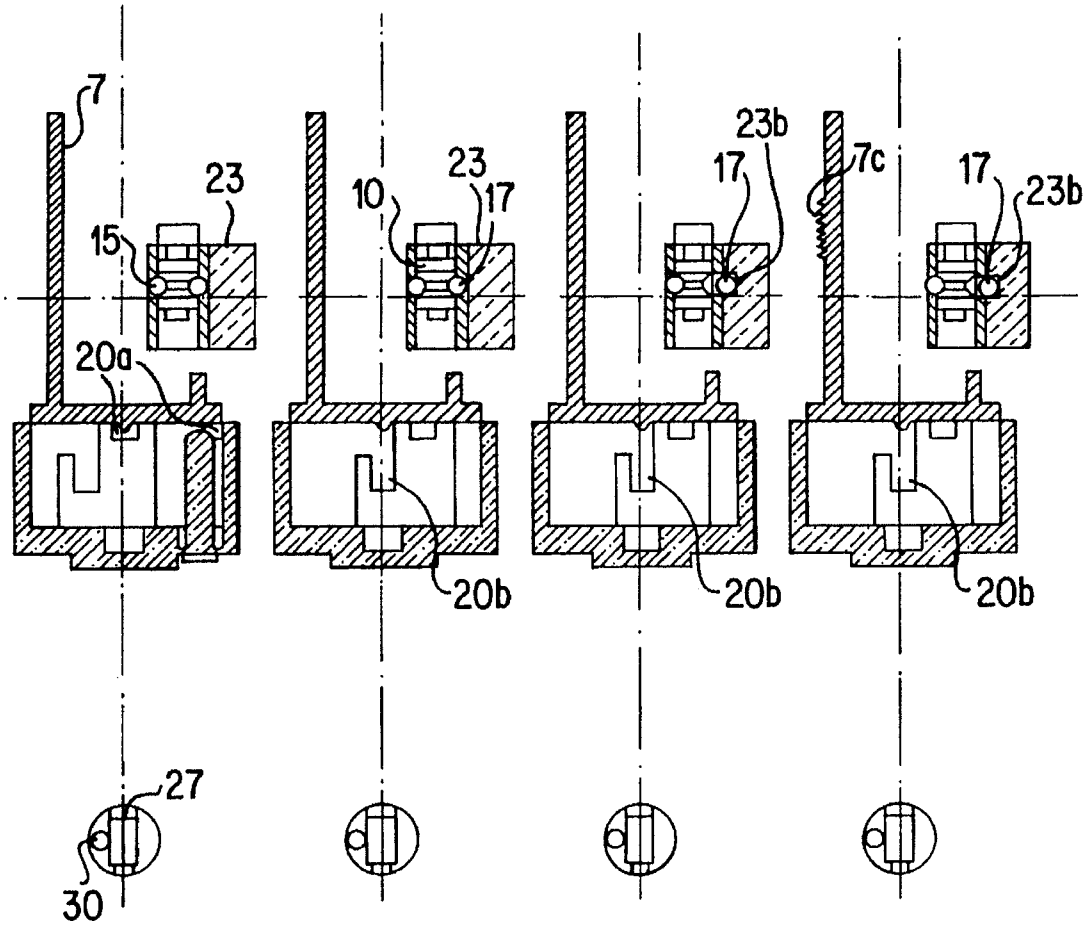
FIGS. 10, 10A, 10B, 10C and 10D are partial schematic views relating to FIG. 1, showing the different positions of certain moving parts in the safe, pyrotechnic train alignment, delay, impact and impact-delay positions respectively.
Figure 10:
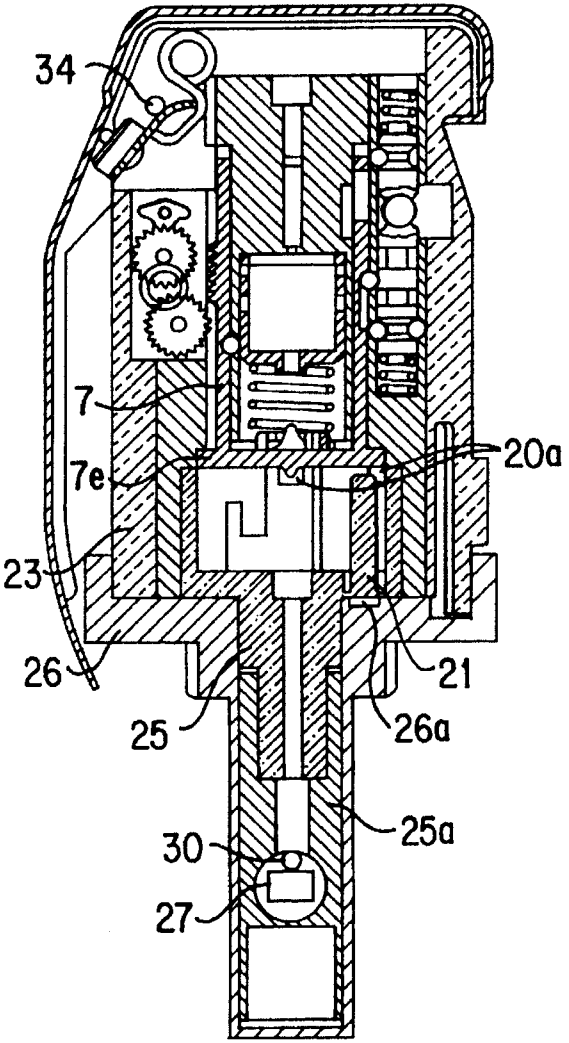

In the initial safe position, the cotter pin 34 cannot be withdrawn, the device 27 in the radial position interrupts the pyrotechnic train, the three studs 7*e* of the firing pin 7 locked in the upper position are opposite the three short openings 20*a*, and the delay and impact detector modules are inactive (FIG. 10).

So long as the locking indicator pin 21 has not entered the recess 26*a*, the operator can rotate the selector 23 in one direction only by pressing on the flexible ratchet 23*a* engaged in the circular gear wheel of the fixed casing 26, in order to select the desired mode of operation.

Figures 9, 9A, 9B, 9C:
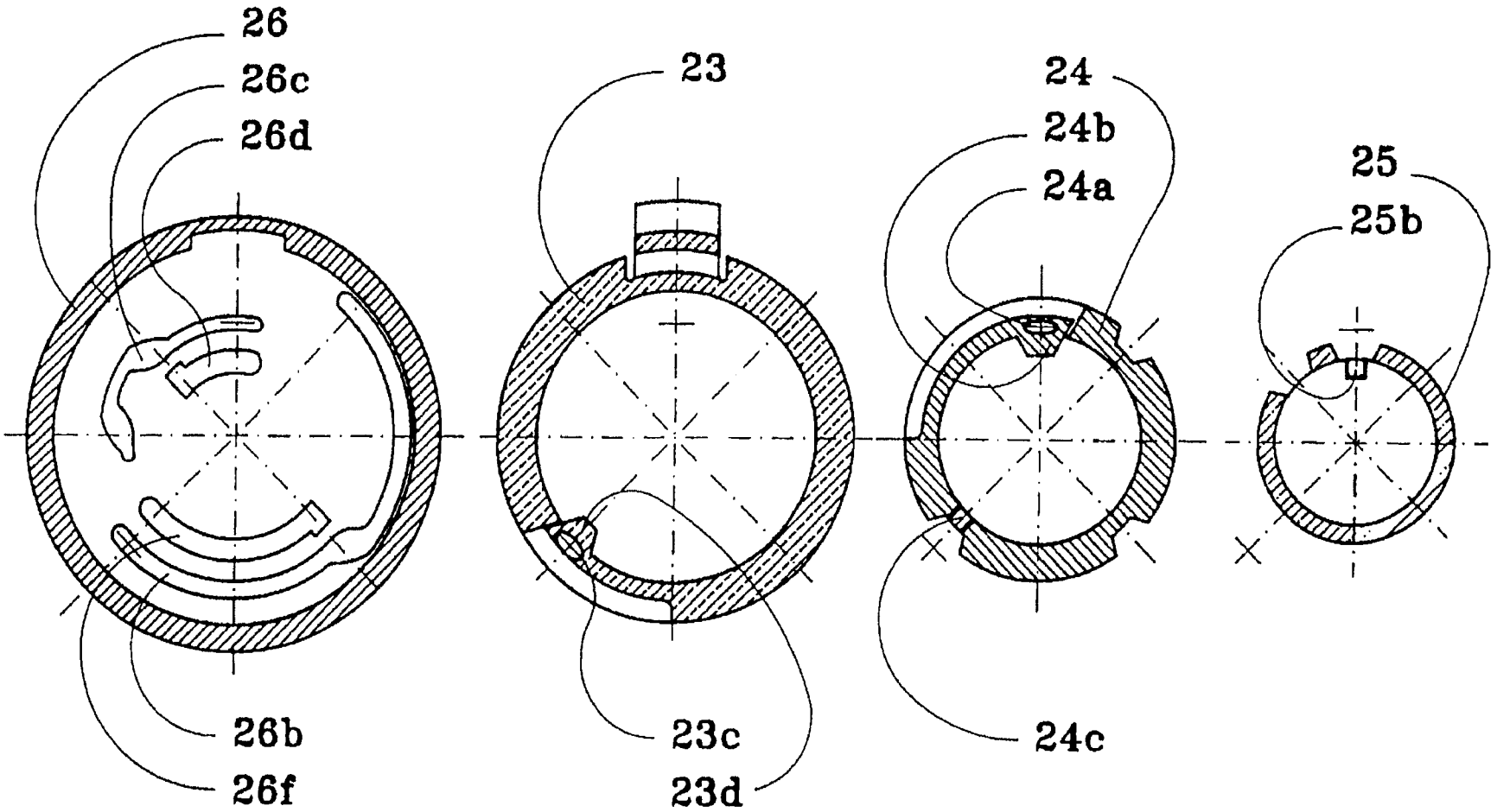
FIGS. 9, 9A, 9B and 9C are radial sections along 9—9 of FIG. 1 at the fixed casing, the selector, the plug body and the top of the internal part enclosing the locking module respectively.

During the angular displacement of the selector 23 from 0° to 45°, the three cylindrical parts 23, 24 and 25 can rotate simultaneously with respect to the fixed casing 26, by two cams 23*d* and 24*b*, which are respectively disposed at the ends of parts 23 and 24, fitted with two pins 23*c* and 24*a* sliding in corresponding grooves 26*b* and 26*c* of the casing (FIGS. 9 to 9B).

When the selector is in the 45° non-indexed position, the pyrotechnic train is aligned (FIG. 10A) by the rotation through 90° of the interruption device 27 produced by the rotation of the internal part 25, the internal part being locked to the casing 26 to keep the train in alignment while the mode of operation is selected. This locking function is provided by a flexible stud 25*b* mounted on the end of part 25, sliding in the groove 26*d* of the casing 26, where it locks in position at the end of the groove (FIGS. 9 and 9C).

It will be noted that the pyrotechnic train can again be placed out of alignment by rotating the selector in the opposite direction and returning it to the safe position. During the angular displacement from 45° to 90°, the two cylindrical parts 23 and 24 remain together and rotate simultaneously with respect to the locked internal part 25.

It will be noted that the firing pin 7 rotates with the cylindrical part 24 being connected to it by the ball 9 engaged in the channel 7*a*, 7*b* of the firing pin.

In the 90° position, corresponding to the delayed operating mode (FIG. 10B), the rotation of the part 24 and hence of the firing pin 7 places the three studs 7*e* of the firing pin opposite the three longer functional locking openings 20*b*, the impact detector module remains locked by the functional locking ball 17 that remains engaged in the groove of the master cylinder 10 by the selector, and the delay module is still separated from the firing pin racks 7*c*.

In this position, the operator can extract the cotter pin 34 by pulling on the ring 34*a* released by the withdrawal of the circular groove 26*e* on the casing 26, the cylindrical part 24 being locked to the top of the internal part 25 by engagement between the rib 26*c* and the flexible cam 24*b* associated with its pin 24*a*.

In this position, corresponding to the impact mode of operation (FIG. 10C), the functional locking ball 17 escapes from the groove on the master cylinder 10 and engages in the internal circular groove 23*b* of the selector to activate the impact detector module.

In this position, as in the previous position, the delay module is separate from the firing pin racks 7*c*. The part 24 is locked on the casing 26 by a stud 24*c* in the groove 26*f* on the casing.

During the angular displacement from 180° to 270°, the selector 23 associated with the delay module rotates about the body 24 of the plug.

In the 270° position, corresponding to the impact-delay mode of operation (FIG. 10D), the gear wheel 18 of the delay module is aligned with the first rack 7*c* of the firing pin corresponding to a percussion delay of one second, and the functional locking ball 17 remains free so the impact detector module remains active.

The other angular positions of the selector which may, for example, be 300°, 320° and 340° correspond respectively to the alignment of the gear wheel 18 with the racks 7*c*2, 7*c*3 and 7*c*4 for percussion delays of seven tenths, four tenths and one tenth of a second. In these last three positions, the impact detector module is also active. Each of these four positions is indexed by the cam 23*c*.

Figure 11B:
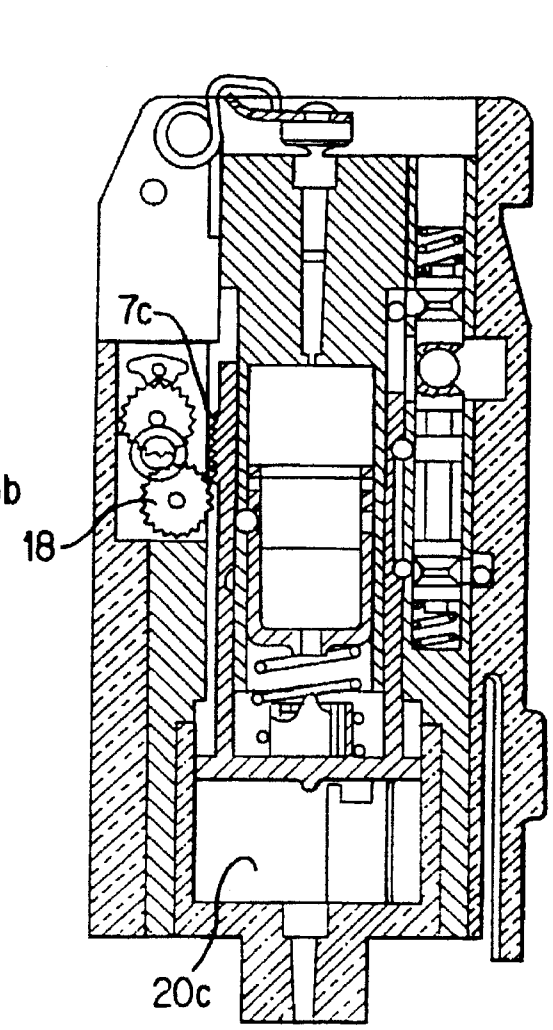
FIGS. 11, 11A and 11B are partial views according to FIG. 1, illustrating the movements of the piston and firing pin up to the armed position of the said pin, in the impact-delay operating mode.
Figure 11A:
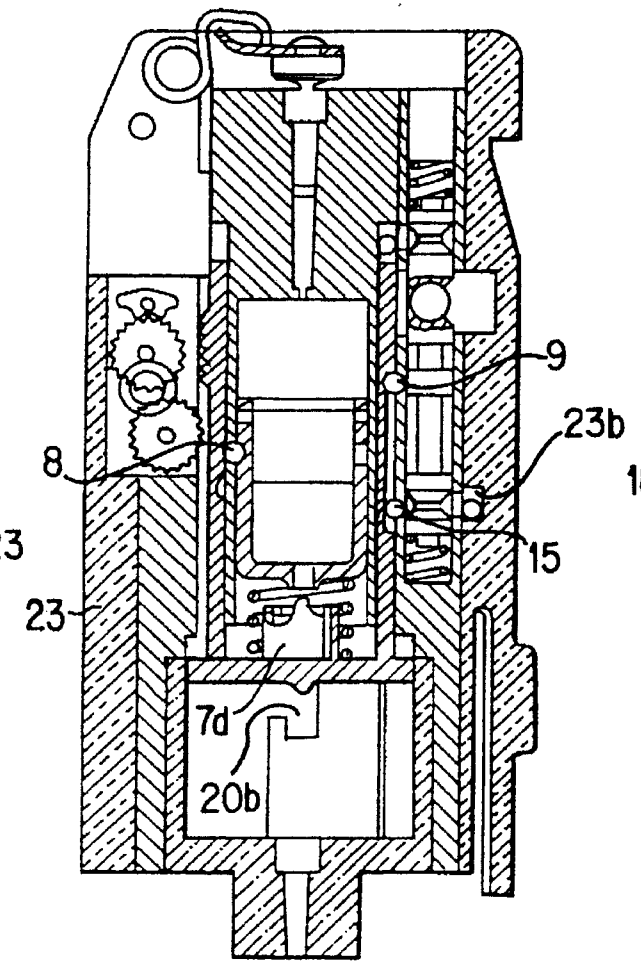
Figure 11:
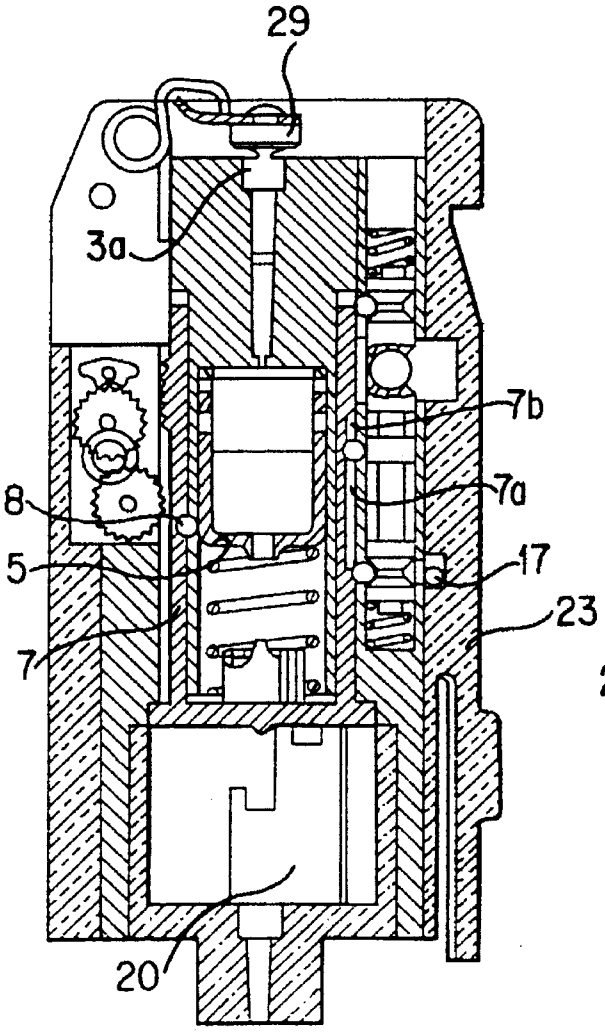
Figure 12C:
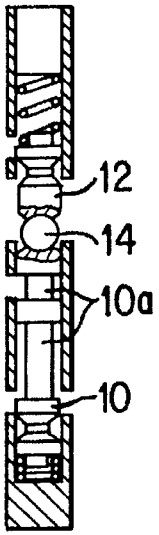
FIG. 12 represents a view according to FIGS. 11 and 11B following ignition resulting from the operation of the impact detector module.
Figure 12B:
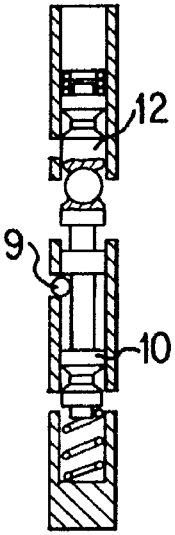
Figure 12A:
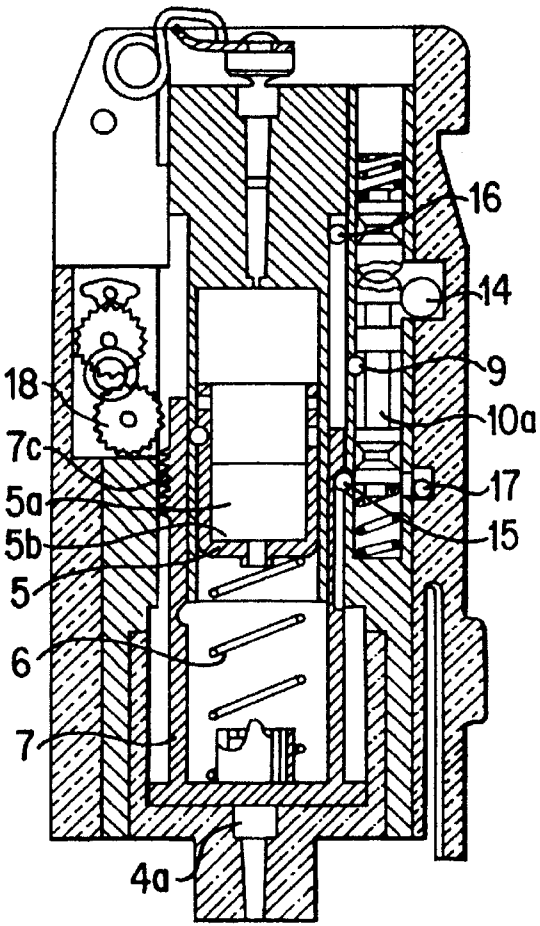

The operation of the device in impact-delay mode mounted on a hand grenade is described below (FIGS. 11, 11B and 12).

Differences in operation according to the other two modes can easily be deduced from this description.

The description assumes the configuration relating to this particular mode of operation, determined by the corresponding position of the selector, described above. The user extracts the cotter pin 34 and throws the grenade.

The handle 22 releases the upper firing pin 29 which strikes the cap 3*a* in the upper part 3 of the pyrotechnic train (FIG. 11). The sequence of actions is then as follows.

Combustion of the pyrotechnic delay 3*b* ignites the booster charge 3*c*, which generates gases causing the axial displacement of the piston 5 and compressing the spring 6.

Once the outer circular groove 5*d* on the piston 5 is opposite the ball 8, the ball releases the firing pin 7. The firing pin then moves axially under the action of the compressed spring 6.

The longitudinal part 7*a* of the channel in the firing pin slides past the ball 9 until it encounters the spiral part 7*b* of the channel (FIG. 11A).

The spiral form of this part of the channel causes the firing pin to rotate through a few degrees. At the end of the spiral part 7*b*, the firing pin is immobilized because it is held captive by the ball 9 (FIG. 11B).

It should be noted that the firing pin 7 forced to rotate by the spiral part of the channel allows the three studs 7*e* on the firing pin to separate from the three long functional locking openings 20*b* on the locking module and to move to a position opposite the three through openings 20*c*, thus effectively arming the device. This design provides a check on the presence of the ball 9 guiding the firing pin and on the initiation of impact, and the integrity of the impact detector module. If one of these elements is faulty, the firing pin descends into the functional safety openings 20*b*.

During its motion, the firing pin releases the two balls 15 and 16 and thus unlocks the impact detector module.

A longitudinal impact producing an axial displacement of the assembly of master cylinder 10, ball 14 and secondary cylinder 12, or a transverse impact displacing the ball 14 radially, which necessarily causes the axial displacement of the master cylinder 10 of which one of the two necks 10*a*, allows the ball 9 to escape from the spiral part 7*b* of the channel, thus releasing the firing pin (FIG. 12).

During its motion towards the lower part 4 of the pyrotechnic train, the firing pin is delayed by the delay module. The rack 7*c* of the firing pin (or one of the shorter racks 7*c*2, 7*c*3 or 7*c*4, depending upon the percussion delay selected) contacts the gear wheel 18 which strongly brakes the firing pin (FIGS. 11B and 12).

Following a delay depending on the length of the rack, the firing pin is released and ignites the lower part 4 of the train by striking the cap 4*a*.

Figure 13:
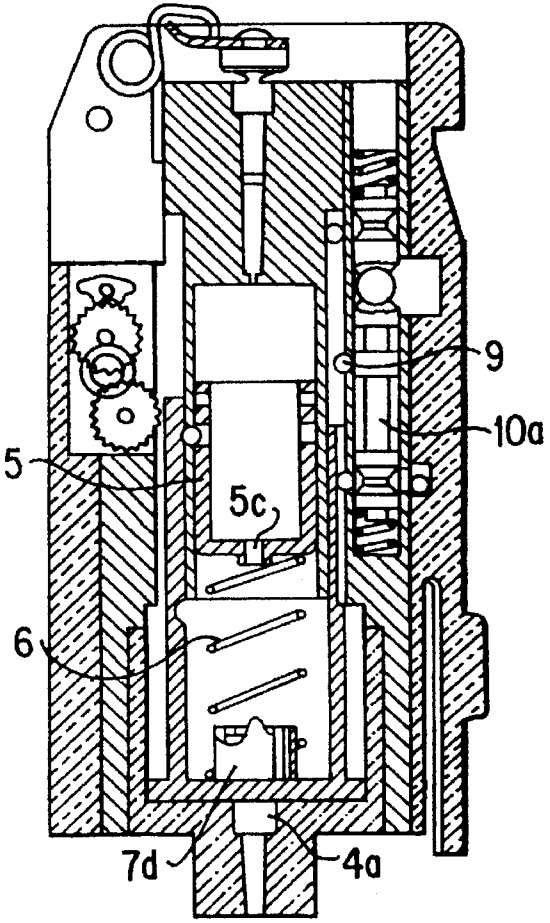
FIG. 13 represents a view according to FIGS. 11 and 11B following ignition resulting from the operation of the self-destruct module.

If the impact detector module does not release the ball 9 within the required time, the self-destruct module contained in the piston 5 becomes active (FIG. 13).

The propellant charge 3*c* ignites the delay composition 5*a*. On completion of combustion, the booster composition 5*b* generates gases which flow through the volute 7*d* and force the firing pin to rotate again. The upper end of the spiral part 7*b* of the channel is then presented to the ball 9 which enters (FIG. 3).

This further rotation of the firing pin moves the rack 7*c* out of alignment with the gear wheel 18 on the delay module such that the self-destruct percussion is instantaneous.

Operation in the impact mode is identical with the impact-delay mode, except that rotation of the selector 23 through 180° leaves the firing pin racks separated from the delay module.

Operation in the delay mode is identical to the impact-delay mode, except that rotation of the selector 23 through 90° also leaves the firing pin racks separated from the delay module and does not release the functional locking ball 17 from the impact detector module. As a result, self-destruction of the grenade is ensured.

We claim:

1. A fuse plug pyrotechnic firing device, comprising:

a body having an axis and a bore disposed along said axis;

a pyrotechnic train disposed along said axis and having an upper part and a lower part;

a firing pin having a firing pin axis, said firing pin being disposed within said bore between said upper part and said lower part and configured to ignite said lower part; and a driving device coupled to said firing pin and to said upper part, and operable to move said firing pin along said axis such that said firing pin ignites said lower part, and wherein said firing pin rotates about said firing pin axis under pressure of gases generated by ignition of said lower part.

2. The fuse plug of claim 1, further comprising a guide device that guides said firing pin through axial and rotational movement, said guide device being disposed within a channel adjacent said bore.

3. The fuse plug of claim 2, wherein said firing pin is shaped to slide within said bore and includes a firing pin bore, and wherein said driving device includes a piston disposed to slide within a fixed casing and a firing pin spring disposed to contact said piston and to extend towards an open end of said fixed casing, said fixed casing at least partially enclosing said upper part of said pyrotechnic train, and wherein said firing pin bore is shaped to slide over said open end of said fixed casing such that said firing pin is urged axially away from said piston by said firing pin spring.

4. The fuse plug of claim 3, wherein said driving device includes locking means for locking said firing pin to said fixed casing, and wherein said locking means includes a ball disposed in an opening through said fixed casing between said firing pin and said piston, said ball in a safe mode position being urged by said piston in a first displacement into an internal circular groove of said firing pin to secure said firing pin, and said ball in an armed position being disposed in an external circular groove of said cylinder in a second displacement such that said ball releases said firing pin.

5. The fuse plug of claim 4, wherein said guide device includes a second ball disposed to project into said bore and engaged in an external channel formed in said firing pin, said channel having a longitudinal part that extends parallel to said firing pin axis and a spiral part adjoined to said longitudinal part, wherein said second ball guides said firing pin to move by an initial displacement when said second ball engages said longitudinal part and to move axially and to rotate by a subsequent displacement when said second ball engages said spiral part.

6. The fuse plug device of claim 5, further comprising a locking module that locks said firing pin, said locking module being disposed between said firing pin and said lower part.

7. The fuse plug of claim 6, wherein said locking module is generally cylindrical and has a periphery that includes three evenly spaced groups of openings, each of said groups of openings having a different length.

8. The fuse plug of claim 7, wherein said firing pin includes three evenly spaced studs disposed adjacent a firing pin periphery opposite said groups of openings in said locking module, said studs being engageable in a first group to lock said firing pin in the safe mode position, in a second group to lock said firing pin in an armed position and in a third group to ignite said lower part of said pyrotechnic train.

9. The fuse plug of claim 8, wherein said piston includes a self-destruct module, said self-destruct module having a gas-generating composition ignitable by said upper part to generate gas under pressure and an exhaust vent disposed along said axis of said bore, wherein said exhaust vent is engageable with an axial volute attached to said firing pin when said cylinder contacts said firing pin to vent the gas, and wherein the gas impinging upon said axial volute rotates said firing pin.

10. The fuse plug of claim 9, wherein said gas-generating composition includes a delay composition and a booster composition.

11. The fuse plug of claim 10, further comprising a head that at least partially surrounds said body, a lower casing connected to said head that at least partially surrounds said lower part and an interruption device coupled to said head, said interruption device being disposed within said lower casing, along said axis and to extend through said lower part of said pyrotechnic train, said interruption device being actuatable to interrupt said lower part by rotating said head by a first amount and to permit ignition of said lower part by rotating said head by a second amount.

12. The fuse plug of claim 11, wherein said interruption device includes a cylinder having an axial orifice, an alignment drum connected to said cylinder and an alignment drum rotating device coupled to said cylinder that rotates said alignment drum between an axial position in which said alignment drum is disposed approximately parallel to said axis and a radial position approximately perpendicular to said axial position.

13. The fuse plug of claim 12, wherein said alignment drum rotating device includes a rotating cylindrical inner part at least partially surrounded by said lower casing, said rotating cylindrical inner part having an upper end connected to said head and a lower end having a barrel, said rotating cylindrical part being rotatable under rotation of said head to rotate said alignment drum.

14. The fuse plug of claim 13, wherein said barrel includes a pin and said lower casing includes a lower spiral groove disposed to receive said pin, and wherein said pin engages said lower spiral groove and guides said lower casing to rotate by approximately 90°.

15. The fuse plug of claim 14, wherein said lower casing includes a rack portion and said barrel includes teeth shaped to engage said rack portion, and wherein engagement between said rack portion and said teeth rotates said alignment drum.

16. The fuse plug of claim 14, wherein said lower part of said pyrotechnic train includes, disposed in order downstream from said firing pin and upstream from said interruption device, a percussion cap, a lead azide charge and a hexogen priming relay, and wherein said pyrotechnic train also includes a principal hexogen relay disposed downstream of said interruption device.

17. The fuse plug of claim 16, wherein said interruption device includes a hexogen-type secondary explosive.

18. The fuse plug of claim 17, further comprising an impact detector module and a delay module, wherein said head is rotatable relative to said body and to select one of a delay mode, an impact mode and an impact-delay mode.

19. The fuse plug of claim 18, wherein said delay module is at least partially surrounded by said head and includes at least one gear wheel, at least one rack attached to an outer wall of said firing pin that engages said at least one gear wheel and a mechanical rocker that controls rotation of said at least one gear wheel, and wherein said delay module is actuated upon impact in the impact-delay mode to delay initiation of said pyrotechnic train by percussion delay.

20. The fuse plug of claim 19, wherein said outer wall of said firing pin includes four racks having different lengths, wherein said different lengths correspond to percussion delay times of approximately 1 s, 0.7 s, 0.4 s and 0.1 s, respectively.

21. The fuse plug according to claim 20, wherein said body includes a impact detector module bore within which said impact detector module is disposed, and wherein said impact detector module includes a master cylinder urged by a master spring, a secondary cylinder urged by a secondary spring, a transverse detection ball interposed between said master cylinder and said secondary cylinder, impact detector positioning balls that guide said impact detector module between locked and unlocked positions and a impact detector module lock-out ball actuatable by rotating said head to disable said impact detector module.

22. The fuse plug of claim 21, wherein said transverse detection ball is made of tungsten.

23. The fuse plug of claim 22, further comprising an upper firing pin disposed to initiate said upper part of said pyrotechnic train, a handle that releases said upper firing pin to initiate said upper part, and a removable pin that secures said handle, wherein said pin includes a pin removal prevention device that prevents removal of said pin and ignition of said pyrotechnic train until when said head is in the safe mode position.

24. The fuse plug of claim 23, wherein said pin removal prevention device includes a circular rib attached to said lower casing and a flexible ratchet attached to and extending above said head, wherein said circular rib is disposed to at least partially enclose said ring when said flexible ratchet engages said ring when said head is in the safe mode position.

25. The fuse plug of claim 24, wherein said head is rotatable from the safe mode position through successive rotations of approximately 90° in a first direction to a delay mode position, to an impact mode position and to an impact-delay mode position, wherein in the safe mode position, said cotter pin is locked by said pin withdrawal prevention device, said interruption device is disposed in said radial position to interrupt said pyrotechnic train, said three studs of said firing pin are disposed opposite a first of said groups of openings that corresponds to the safe mode position, said ball is urged by said cylinder to engage said internal circular groove of and to lock said firing pin, said at least one gear wheel is separated from said four racks, said impact detector module lock-out ball is positioned to disable said impact detector module, and said impact detector module positioning balls are positioned to lock said master cylinder and said secondary cylinder, wherein in the delay mode position corresponding to a first rotation of said head through 90°, said pin withdrawal prevention device is disabled, said interruption device is disabled through rotation of said alignment drum by 90°, said three studs are aligned with a second of said three groups of openings that corresponds to said delay mode position, and said delay module and said impact detector module remain disabled, wherein in the impact mode corresponding to a second rotation of said head through 90°, said impact detector module lock-out ball is released to engage an internal groove of said head and to enable said impact detector module, and wherein in the impact-delay mode corresponding to a third rotation of the head through 90°, said at least one gear wheel is aligned with said first of said four racks corresponding to a delay time of 1 s and said impact detector module remains enabled.

26. The fuse plug of claim 25, wherein when said head is in the impact-delay mode position, three successive rotations in said first direction align said at least one gear wheel with, respectively, a second of said four racks corresponding to a delay time of 0.7 s, a third of said four racks corresponding to a delay time of 0.4 s and a fourth of said four racks corresponding to a delay time of 0.1 s.

27. The fuse plug of claim 26, wherein when said head is in one of the impact mode position and the impact-delay mode position and said impact detector module is disabled, said self-destruct module ignites said lower part of said pyrotechnic train.

* * * * *